US010758970B2

(12) United States Patent
Böcking et al.

(10) Patent No.: US 10,758,970 B2
(45) Date of Patent: Sep. 1, 2020

(54) CATERPILLAR CASTING MACHINE AND METHOD FOR PRODUCING A CAST MATERIAL FROM LIQUID METAL

(71) Applicant: SMS GROUP GMBH, Düsseldorf (DE)

(72) Inventors: Sebastian Böcking, Siegen (DE); Guido Fick, Kreuztal (DE)

(73) Assignee: SMS GROUP GMBH, Düsseldorf (DE)

( * ) Notice: Subject to any disclaimer, the term of this patent is extended or adjusted under 35 U.S.C. 154(b) by 0 days.

(21) Appl. No.: 16/464,636

(22) PCT Filed: Nov. 24, 2017

(86) PCT No.: PCT/EP2017/080403
§ 371 (c)(1),
(2) Date: May 28, 2019

(87) PCT Pub. No.: WO2018/099829
PCT Pub. Date: Jun. 7, 2018

(65) Prior Publication Data

US 2019/0381560 A1 Dec. 19, 2019

(30) Foreign Application Priority Data

Nov. 29, 2016 (DE) ..... 10 2016 223 717

(51) Int. Cl.
*B22D 11/06* (2006.01)
*B22D 11/14* (2006.01)
*B22D 11/18* (2006.01)

(52) U.S. Cl.
CPC ..... *B22D 11/0608* (2013.01); *B22D 11/0657* (2013.01); *B22D 11/0685* (2013.01);
(Continued)

(58) Field of Classification Search
CPC ..... B22D 11/0608; B22D 11/0657; B22D 11/0685; B22D 11/0688
See application file for complete search history.

(56) References Cited

U.S. PATENT DOCUMENTS 3,570,583 A 3/1971 Lauener
4,682,646 A 7/1987 Hulek
(Continued)

FOREIGN PATENT DOCUMENTS

AT 381878 B 12/1986
DE 1758933 A1 3/1971
(Continued)

*Primary Examiner* — Kevin E Yoon
(74) *Attorney, Agent, or Firm* — Lucas & Mercanti, LLP; Klaus P. Stoffel

(57) ABSTRACT

A caterpillar casting machine for producing a cast material from liquid metal, including two guide rails, which are used to form two endless horizontal circulating tracks arranged opposite each other, and a plurality of support elements, which are each guided on the guide rails with cooling blocks attached thereto such that a continuous chain of support elements is formed. The support elements are moved in a transport direction along the circulating tracks. Between the cooling blocks, which arrive at the opposite position in straight sections of the circulating tracks of the guide rails, a moving casting mold for the cast material is formed. A cooling device is also provided, which has separate cooling zones each with at least one cooling nozzle, wherein the cooling zones can be individually controlled along the transport direction and/or transverse to the transport direction to adjust an opening or closing of the cooling nozzles.

9 Claims, 3 Drawing Sheets

(52) U.S. Cl.
CPC ..... *B22D 11/0688* (2013.01); *B22D 11/14* (2013.01); *B22D 11/181* (2013.01)

(56) References Cited

U.S. PATENT DOCUMENTS

| | | | | | |
|---|---|---|---|---|---|
| 5,363,902 | A * | 11/1994 | Kush | B22D 11/0685 | 164/485 |
| 5,697,423 | A * | 12/1997 | Roder | B22D 11/0605 | 164/154.7 |
| 5,826,640 | A | 10/1998 | Lauener | | |
| 7,614,441 | B2 | 11/2009 | Lauener | | |
| 2008/0000612 | A1* | 1/2008 | Bausch | B22D 11/0685 | 164/463 |
| 2016/0199905 | A1 | 7/2016 | Bausch et al. | | |

FOREIGN PATENT DOCUMENTS

| | | | |
|---|---|---|---|
| DE | 102008031476 | A1 | 2/2009 |
| EP | 0873211 | B2 | 9/2002 |
| EP | 1704005 | B1 | 8/2007 |
| WO | 9526841 | A1 | 10/1995 |
| WO | 9527145 | A1 | 10/1995 |
| WO | 9726100 | A1 | 7/1997 |
| WO | 2005068108 | A1 | 7/2005 |

* cited by examiner

CATERPILLAR CASTING MACHINE AND METHOD FOR PRODUCING A CAST MATERIAL FROM LIQUID METAL

CROSS-REFERENCE TO RELATED APPLICATIONS

The present application is a 371 of International application PCT/EP2017/080403, filed Nov. 24, 2017, which claims priority of DE 10 2016 223 717.9, filed Nov. 29, 2016, the priority of these applications is hereby claimed and these applications are incorporated herein by reference.

BACKGROUND OF THE INVENTION

The invention relates to a caterpillar casting machine for producing a cast material from liquid metal and to a corresponding method.

In the prior art, horizontal block casting machines which function in the manner of a revolving caterpillar casting machine are known in particular for the production of aluminum alloys. Such a casting machine is known, for example, from EP 1 704 005 B1 or WO 95/27145. The cooling elements of the casting machine herein on the straight portions, or on spans of casting caterpillars that are disposed so as to be mutually opposite, respectively, form the wall of a moving casting mold. The casting caterpillars are in each case composed of a multiplicity of cooling blocks which are connected to one another in an endless manner and which are transported along the circulation tracks of the caterpillars. For this purpose, the cooling blocks are assembled on support elements which are placed onto chains and are thus connected to one another in an articulated manner like links of a chain.

Cooling systems for a continuous strip casting line in which a plurality of nozzles are provided for supplying cooling means are in each case known from EP 0 873 211 B2 and WO 97/26100. In the case of said cooling systems according to the prior art it is disadvantageous that no dedicated cooling zones are provided and a cooling rate per permanent mold is not established. Rather, in order for the cooling rate to be varied it is necessary for a line operator to manually perform such variations, this being problematic also with a view to operational safety.

WO 2005/068108 A1 discloses a generic caterpillar casting machine and a corresponding method.

SUMMARY OF THE INVENTION

The invention is accordingly based on the object of optimizing a caterpillar casting machine and a corresponding method for producing a cast material from liquid metal in terms of a variability of the production process.

A caterpillar casting machine according to the present invention serves the purpose of producing a cast material from a liquid metal. To this end, the caterpillar casting machine comprises two guide rails by way of which two endless horizontal circulation tracks that are disposed so as to be opposite one another are formed; a plurality of support elements which are in each case guided on the guide rails having cooling blocks attached thereto in such a manner that a continuous chain of support elements which in a transporting direction are moved along the circulation tracks is formed, wherein a moving casting mold for the cast material is configured between the cooling blocks which in straight portions of the circulation tracks of the guide rails are positioned so as to be mutually opposite; and a cooling installation for cooling the cooling blocks. The cooling installation has separate cooling zones having in each case at least one cooling nozzle, wherein the cooling zones are individually actuatable along the transporting direction and/or transversely to the transporting direction in order for opening or closing, respectively, of the cooling nozzles to be set. Cooling for the cooling blocks is adaptable to a predetermined casting width in that the cooling zones with the cooling nozzles thereof in a peripheral region transversely to the transporting direction are actuated. In additional and/or alternatively, a cooling for the cooling blocks is adaptable to at least one predetermined process parameter made up of a type of metal, a predetermined metal alloy, casting width, casting speed, or casting profile, in that the cooling zones with cooling nozzles in the transporting direction are actuated.

In the same way, the present invention also provides a method for producing a cast material from liquid metal. The liquid metal herein is cast in a moving casting mold which is formed between cooling blocks which are attached to support elements that in a transporting direction move along in each case two endless circulation tracks that are disposed so as to be opposite one another. Separate cooling zones having in each case at least one cooling nozzle are in each case individually actuated along the transporting direction and/or transversely to the transporting direction in order for the cooling nozzles to be opened or to be closed on account thereof. Individually actuating the cooling zones in a peripheral region transversely to the transporting direction so as to adapt cooling for the cooling blocks to a predetermined casting width and/or actuating the cooling zones with their cooling nozzles along the transporting direction so as to adapt cooling to a predetermined process parameter based on a type of metal, a predetermined metal alloy, casting width, casting speed, or casting profile.

In the context of the present invention, the transporting direction in which the support elements having the cooling blocks attached thereto are moved along the respective guide rails and the circulation tracks configured on account of the latter is synonymous with the casting direction in which the liquid metal is cast in the moving casting mold which is formed between the cooling blocks in the straight portions of the opposite horizontal circulation tracks.

On account of the plurality of cooling blocks which are fastened to the support elements and which are guided along the endless horizontal circulation tracks, one upper caterpillar and one lower caterpillar are formed in each case. The moving casting mold within which a cast material is generated is configured in the straight portions of the spans of said two caterpillars which run in a mutually opposite manner.

The invention is based on the essential concept that the cooling installation has separate cooling zones having in each case at least one cooling nozzle, said cooling zones being able to be individually actuated. On account thereof, it is possible for resulting cooling of the cooling blocks, and thus of the cast material generated in the moving casting mold, to be set in a targeted manner, for example as a function of the chosen casting width and/or of the type of the cast material. For example, proceeding from an initial operating position in which all cooling nozzles are opened, cooling nozzles in a peripheral region are closed in a targeted manner transversely to the transporting or casting direction, respectively, in order for the resulting cooling to be adapted to a narrower casting width. Additionally and/or alternatively, it can be provided that, proceeding from the initial operating position, selected cooling zones and the cooling nozzles thereof can be closed along the transporting or casting direction, respectively, in order for the resulting cooling effect to be reduced in the casting direction and, on account thereof, achieve an adaptation to a specific process parameter, in particular the type of metal, a predetermined grade of metal, or a metal alloy that is cast in the moving casting mold, the casting width, the casting speed, or the casting profile.

In an advantageous refinement of the invention it can be provided that the cooling installation by way of the cooling nozzles thereof is disposed in such a manner that a cooling medium that is dispersed by the cooling nozzles acts directly on the cooling blocks. This is possible for the cooling blocks of the upper caterpillar and/or of the lower caterpillar. For example, a cooling installation can be disposed above an upper span of the upper caterpillar and/or below a lower span of the lower caterpillar, such that a cooling medium, preferably pressurized water, can be dispersed or sprayed, respectively, directly onto a surface of the cooling blocks by way of the cooling nozzles. Additionally and/or alternatively, at least one cooling installation can be disposed or received, respectively, in an intermediate space between the spans of the upper and lower caterpillar, respectively, wherein in this instance a cooling medium, preferably pressurized water, is sprayed onto a rear side of the cooling blocks by way of the cooling nozzles.

In an advantageous refinement of the invention it can be provided that the cooling installation, conjointly with the associated cooling zones thereof, is configured in multiple parts. On account of said multiple parts of the cooling zones, an adaptation to the cooling blocks which are to be cooled in the intended manner is advantageously possible.

In an advantageous refinement of the invention a control installation by means of which the individual cooling nozzles in the respective cooling zones can be actuated can be provided. A predetermined cooling model is stored or memorized, respectively, in a memory of said control installation, wherein an actuation of the nozzles is performed based on said cooling model. In this way, a temperature management of the cast material within the casting mold is automatically influenced, on account of which the product quality as well as the economy are optimized. The necessity of a manual setting, for example by a hand wheel, as this is still required in the case of conventional caterpillar casting machines, is in particular rendered superfluous by such an automatic temperature management.

A precise adaptation to at least one predetermined process parameter, in particular the type of metal, a predetermined metal alloy, the casting width, the casting speed, or the casting profile can also be achieved according to one advantageous refinement of the invention in that in part-regions of the cooling installation each cooling nozzle is individually actuated. This can be implemented by means of the aforementioned control installation.

Preferred embodiments of the invention are described in detail hereunder by means of a schematically simplified drawing.

DETAILED DESCRIPTION OF THE INVENTION

Figure 1:
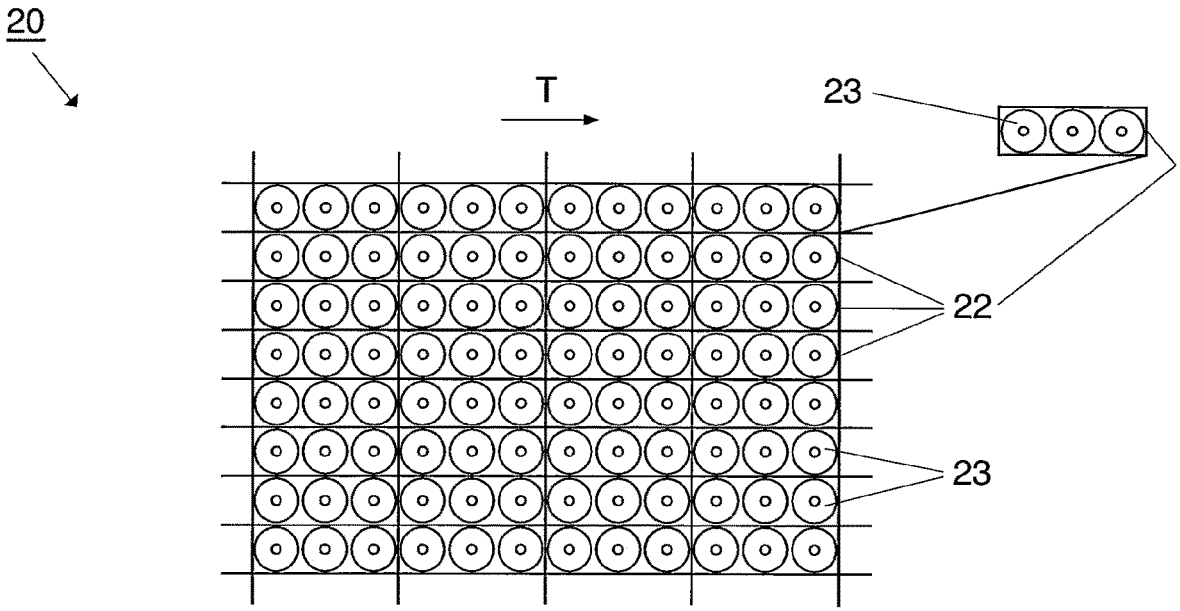
FIG. 1 shows a plan view of a cooling installation and the cooling zones thereof, said cooling installation and said cooling zones being part of a caterpillar casting machine according to the invention.

Preferred embodiments of a caterpillar casting machine 10 according to the invention and the components thereof are explained hereunder with reference to FIGS. 1 to 6, said caterpillar casting machine 10 serving for producing a cast material 11 (cf. FIG. 6) from liquid metal, in particular aluminum. Identical features are in each case provided with the same reference signs in the drawing. It is explicitly pointed out here that the figures illustrated in the drawing are shown only in a simplified manner and are in particular not to scale.

The caterpillar casting machine 10 has at least one cooling installation 20 which comprises separate cooling zones 22 having in each case a plurality of cooling nozzles 23. A schematically simplified plan view of such a cooling installation 20 is illustrated in FIG. 1. Before discussing details of said cooling installation 20, which is part of the caterpillar casting machine 10, the structural construction of such a caterpillar casting machine 10 is first explained.

Figure 5:
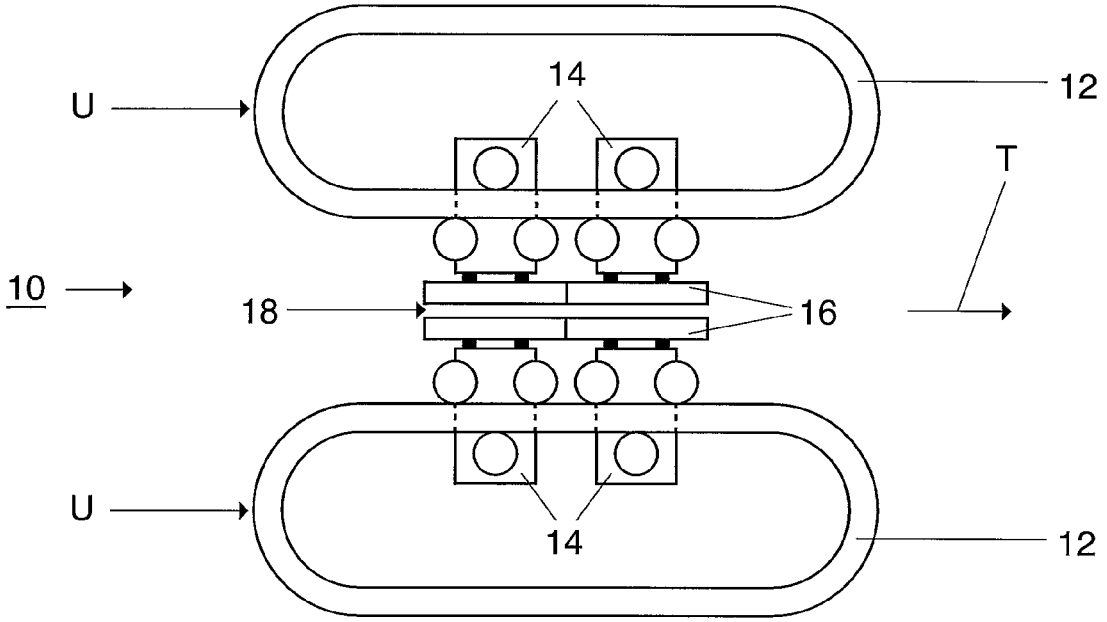
FIG. 5 shows a lateral view of two guide rails by way of which two endless circulation tracks that are disposed so as to be opposite one another are formed for a caterpillar casting machine according to the invention.

FIG. 5 shows a lateral view of two guide rails 12 by way of which two endless horizontal circulation tracks U that are disposed so as to be opposite one another are formed for the caterpillar casting machine 10. A plurality of support elements 14 having cooling blocks 16 attached thereto are herein in each case guided along each guide rail 12 in such a manner that a continuous chain of support elements 14 which is moved or transported, respectively, in a transporting direction T along the guide rails 12 is formed. In order for the functional mode of the present invention to be visualized, only two support elements 14 having cooling blocks 16 attached thereto are in each case shown on the two guide rails 12 in FIG. 5.

FIG. 5 highlights that a casting mold 18 is configured between the cooling blocks 16 which in the straight portions of the circulation tracks U formed by the guide rails 12 are positioned so as to be mutually opposite. Taking into account the transporting direction T of the support elements 14 along the guide rails 12, this casting mold 15 is a casting mold that moves in the transporting direction T.

Figure 6:
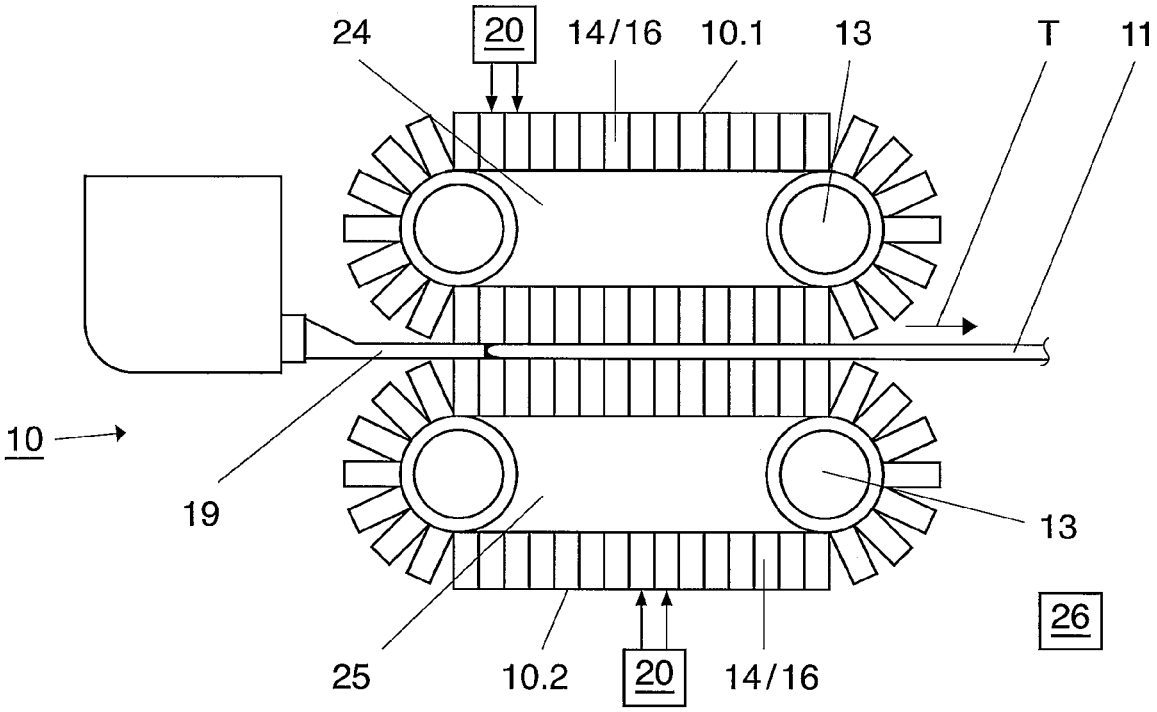
FIG. 6 shows a lateral view of a caterpillar casting machine according to the invention, the endless circulation tracks of said caterpillar casting machine being formed by the guide rails according to FIG. 5, and in which a cooling installation according to one of FIGS. 1-4 is used.

FIG. 6 shows a simplified lateral view of the caterpillar casting machine 10 according to the invention. The caterpillar casting machine 10 has an upper caterpillar 10.1 and a lower caterpillar 10.2, which are in each case formed from a plurality of support elements 14 and cooling blocks 16 attached thereto, as has already been explained above, said support elements 14 and cooling blocks 16 being moved in the transporting direction T along the circulation tracks U formed by the guide rails 14. The drive of the caterpillars 10.1, 10.2 is in each case performed by way of drive wheels 13 which ensure a movement of the support elements 14 and the cooling blocks 16 fastened thereto about the circulation tracks U. Liquid metal (for example, aluminum or an aluminum alloy) is cast in the moving casting mold 18 by means of a casting nozzle 19 which is configured so as to be elongate and by way of the outlet thereof protrudes into the casting mold 18. A cast material 11 is generated by the metal solidifying within the casting mold 18, said cast material 11, as indicated in the right image region of FIG. 6, exiting from the casting gap 18 downstream of the caterpillars 10.1, 10.2 and then being fed to processing (not shown).

The caterpillar casting machine 10 comprises at least one cooling installation 20 by means of which, for example, the cooling blocks 16 can be cooled, said cooling blocks 16 being fastened to the support elements 14 and, in a manner adjacent to the casting mold 18, circulating in the transporting direction T along the circulation tracks U that are configured by the guide rails 14. Cooling installations 20, by means of suitable mountings (not shown), are disposed above the upper span of the upper caterpillar 10.1 as well as below the lower span of the lower caterpillar 10.2 (cf. FIG. 6). For example, pressurized water can be sprayed directly onto the cooling blocks 16 by way of said cooling installations 20 and the associated cooling nozzles 23, this in FIG. 6 being symbolized by corresponding arrows.

The cooling installations 20 in the illustration of FIG. 6 are in each case symbolized only in a simplified manner by rectangles.

The caterpillar casting machine 10 comprises a control installation 26 (cf. FIG. 6) by means of which the cooling nozzles 23 of one or a plurality of cooling installation(s) 20 can be suitably actuated in order for the resulting cooling output to be set. For this purpose, the control installation 26 in terms of signal technology can be connected to a pump installation, for example. This control installation in FIG. 6 is illustrated only in a symbolic manner in the form of a rectangle.

In terms of the embodiment of FIG. 6 it is guaranteed by way of a backflow installation (not shown) that cooling medium which has been dispersed by way of the cooling nozzles 23, once said cooling medium has bounced off the cooling blocks 16, or in the use of water has dripped from said cooling blocks 16, is collected in a suitable manner and is returned to a water management system (not shown) of the caterpillar casting machine 10.

The cooling installation 20 shown in FIG. 1 can be part of the caterpillar casting machine 10 of FIG. 6, wherein the transporting direction T in FIG. 1 is likewise symbolized by an arrow. The cooling installation 20 has a plurality of separate cooling zones 22. Three cooling nozzles 23 (symbolized in a simplified manner by circles) are disposed beside one another within one cooling zone 22, wherein in the illustration of FIG. 1, at the top right in the image region, a cooling zone 22 for visualization is shown individually as being extracted.

The cooling zones 22 of the cooling installation 20 are disposed in the form of a matrix. In detail, a total of four cooling zones 22 (having in each case three cooling nozzles 23 that are disposed beside one another) are provided when viewed in the transporting direction T. A total of eight cooling zones 22 are provided across the width of the casting mold 18, that is to say in a direction transverse to the transporting direction T, in the case of the embodiment of FIG. 1. In this context it is understood that said matrix for the cooling installation 20 can also have a number of cooling zones 22 or cooling nozzles 23, respectively, that deviates from the illustration in FIG. 1.

As has already been explained elsewhere above, it can be provided for the invention that, for example, pressurized water is sprayed onto the cooling blocks 16 from the cooling nozzles 23.

A cooling installation 20 is shown in an initial operating position in FIG. 1, in which initial operating position all of the cooling nozzles 23 are opened. Proceeding from said initial operating position it is possible for some of said cooling nozzles 23 to be closed in a targeted manner by way of an actuation by means of the control installation 26, this leading to a correspondingly reduced cooling output and being explained hereunder with reference to FIGS. 2 to 4.

Figure 2:
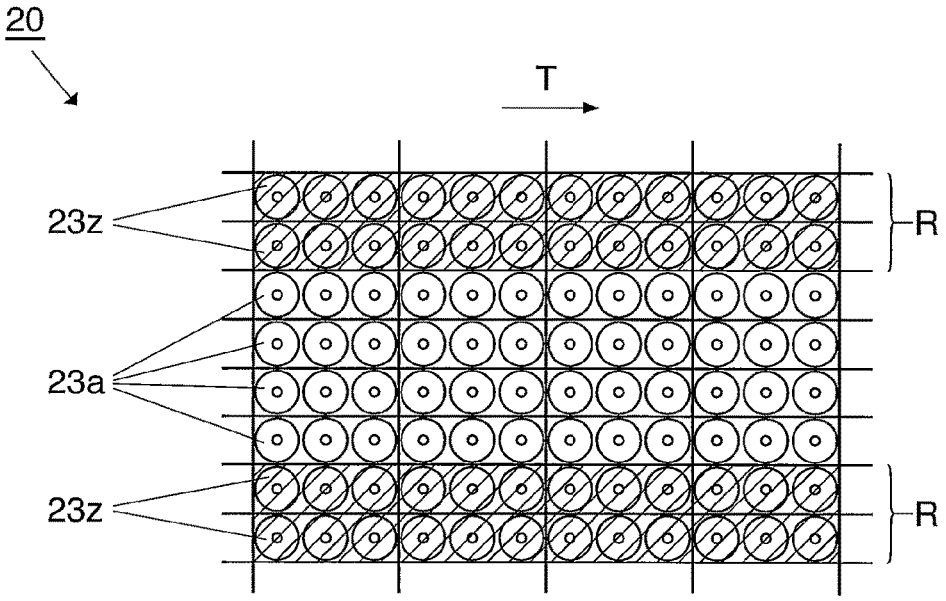
FIGS. 2-4 show plan views of the cooling installation of FIG. 1 in potential operating states.

The Illustration of FIG. 2 visualizes that cooling nozzles here in a peripheral region R of the casting mold 18 are closed, this being symbolized by a hatching of said cooling nozzles and being identified by the reference sign "23*z*". The remaining cooling nozzles which continue to be open and from which a cooling medium is thus dispersed, are not hatched in the illustration of FIG. 2 and are provided with the reference sign "23*a*". As can be seen, all of the cooling nozzles 23*a* in a centric region of the casting mold 18 along the transporting direction T are opened in the operating position according to FIG. 2.

On account of associated cooling nozzles 23 in peripheral regions R of the casting mold 18 being able to be opened or closed in a targeted manner as explained, the cooling for the cast material 11 can be adapted to different casting widths, wherein a saving in terms of energy is achieved by way of regulating a pump in a corresponding manner. For example, less water is required across the width of the casting mold 18 for narrower casting widths, when cooling nozzles 23*z* in the peripheral regions R of the casting mold 18 are closed, as explained. It is also possible herein for an influencing of the casting profile to be achieved by a targeted switching of individual cooling zones (that is to say opening or closing associated cooling nozzles 23). However, in order for the casting profile to be influenced, it may also be necessary for peripheral zones of the casting mold 18 to be cooled to a lesser extent or not at all, so as to avoid in a targeted manner so-called "cold shoulders".

Figure 3:
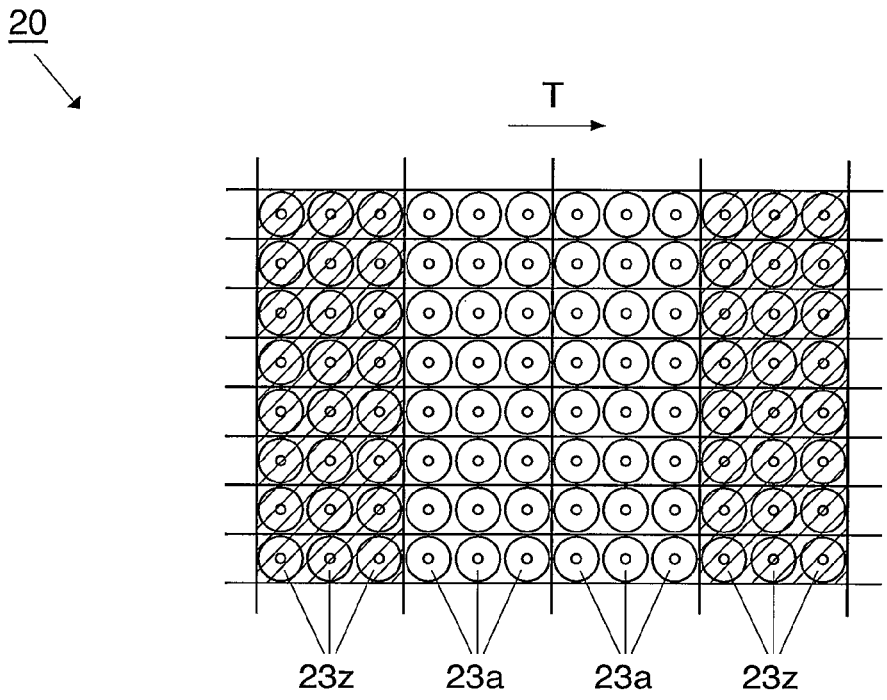

FIG. 3 visualizes a further potential operating position for the cooling installation 20. The cooling nozzles herein are closed in selected cooling zones 22 across the entire width of the casting mold 18, that is to say transversely to the transporting direction T, this being symbolized by a hatching of the associated circular symbols of said cooling nozzles and being indicated by the reference sign "23*z*". When viewed in the transporting direction T, selected cooling nozzles 23*z* are thus closed by way of an actuation by means of the control installation 26, this in these regions of the casting mold 18 leading to a reduced cooling output. The temperature of the cast material 11 and thus also the casting speed can be influenced in a targeted manner on account thereof. In other words, the temperature profile in the cast material 11 can be influenced in a targeted manner by way of such "transverse switching-off" in the form of closing cooling nozzles 23*z* across the entire width of the casting mold 18, transversely to the transporting direction T. As compared to a variation of the casting speed, such a temperature adaptation can allow a better response to the cast material 11, or to the strip formed therefrom, on account of which humps or cracks in the cast material 11 can be avoided, for example.

Figure 4:
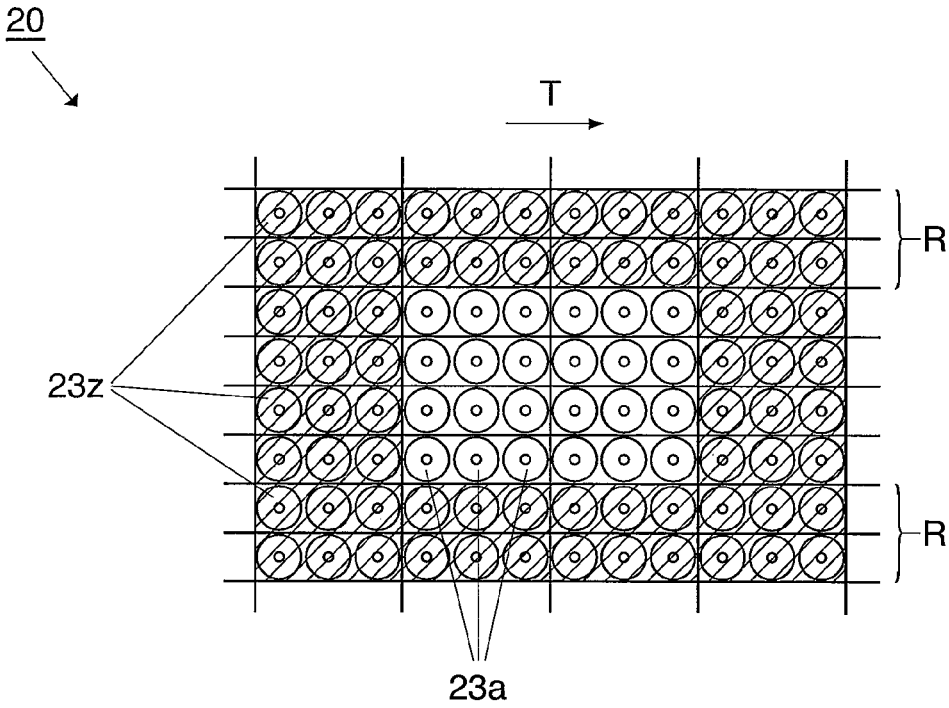

The operating position illustrated in FIG. 4 corresponds to a combination of the operating positions of FIG. 2 and FIG. 3. Cooling nozzles 23*z* herein are closed across the width of the casting mold 18 (that is to say transversely to the transporting direction T) as well as along the transporting direction T by means of a suitable actuation by means of the control installation 26. The remaining open cooling nozzles in the illustration of FIG. 4 are shown in a manner non-hatched and in an exemplary manner are provided with the reference sign "23*a*".

On account of the actuation of the cooling zones 22 which has been explained above and by way of which selected cooling nozzles can be opened (23*a*) or closed (23*z*), a targeted cooling output can be set in the assigned regions of the casting mold 18 along the transporting direction T and/or transversely to the latter.

An advantageous automation of the production process can be achieved in that a cooling model is stored in a memory of the control installation 26. The temperature management and the profile of the cast material 11 generated can be influenced based on said model.

LIST OF REFERENCE SIGNS

10 Caterpillar casting machine
10.1 Upper caterpillar
10.2 Lower caterpillar
11 Cast material
12 Guide rails
13 Drive wheel
14 Support element
16 Cooling block
18 Casting mold
19 Casting nozzle
20 Cooling installation
22 Cooling zone
23 Cooling nozzles
23*a* Opened cooling nozzles
23*z* Closed cooling nozzles
24 Intermediate space
25 Intermediate space
26 Control Installation
R Peripheral region
T Transporting direction/Casting direction
U Circulation track

The invention claimed is:

1. A caterpillar casting machine for producing a cast material from liquid metal, comprising:

two guide rails arranged to form two endless horizontal circulation tracks that are disposed so as to be opposite one another;

a plurality of support elements which are in each case guided on the guide rails so as to form a continuous chain of support elements which in a transporting direction are moved along the circulation tracks;

cooling blocks attached to the support elements to form a moving casting mold for the cast material between the cooling blocks which in straight portions of the circulation tracks of the guide rails are positioned so as to be mutually opposite; and a cooling installation, wherein the cooling installation has separate cooling zones having in each case at least one cooling nozzle, wherein the cooling zones are individually actuatable along the transporting direction and/or transversely to the transporting direction for setting opening or closing of the cooling nozzles, wherein cooling for the cooling blocks is adaptable to a predetermined casting width in that the cooling zones with the cooling nozzles thereof in a peripheral region transversely to the transporting direction are actuated and/or wherein cooling for the cooling blocks is adaptable to at least one predetermined process parameter made up of a type of metal, a predetermined metal alloy, the casting width, casting speed, or the casting profile, in that the cooling zones by way of the cooling nozzles thereof in the transporting direction are actuated.

2. The caterpillar casting machine according to claim 1, wherein the cooling zones of the cooling installation are disposed so that a cooling medium dispersed by the cooling nozzles acts on the cooling blocks.

3. The caterpillar casting machine according to claim 2, wherein the cooling nozzles of the separate cooling zones are directed toward the cooling blocks of an upper caterpillar.

4. The caterpillar casting machine according to claim 3, wherein the cooling installation is disposed above an upper span of the upper caterpillar, wherein the cooling medium is dispersible from above onto the cooling blocks by way of the cooling nozzles.

5. The caterpillar casting machine according to claim 2, wherein the cooling nozzles are directed toward the cooling blocks of a lower caterpillar.

6. The caterpillar casting machine according to claim 5, wherein the cooling installation is disposed below a lower span of the lower caterpillar, wherein the cooling medium is dispersible from below onto the cooling blocks by way of the cooling nozzles.

7. The caterpillar casting machine according to claim 1, further comprising a control installation for actuating individual cooling nozzles in the respective cooling zones, wherein the control installation has a memory in which a predetermined cooling model is stored, wherein an actuation of the cooling nozzles is carried out based on said cooling model.

8. A method for producing a cast material from liquid metal, comprising the steps of: casting the liquid metal in a moving casting mold that is formed between cooling blocks that are attached to support elements that in a transporting direction move along in each case two endless circulation tracks that are disposed so as to be opposite one another; providing a cooling installation, having separate cooling zones with in each case at least one cooling nozzle therein, along the transporting direction and/or transversely to the transporting direction, said cooling zones being in each case individually actuated in order for the at least one cooling nozzle to be opened or to be closed; and actuating the cooling zones in a peripheral region transversely to the transporting direction so as to adapt cooling for the cooling blocks to a predetermined casting width and/or actuating the cooling zones with their cooling nozzles along the transporting direction so as to adapt cooling to a predetermined process parameter based on a type of metal, a predetermined metal alloy, casting width, casting speed, or casting profile.

9. The caterpillar casting machine according to claim 8, further comprising providing a control installation for actuating the individual cooling nozzles in the respective cooling zones, wherein the control installation has a memory in which a predetermined cooling model is stored, wherein the cooling nozzles are actuated based on the cooling model to thereby influence a temperature management of the cast material in the casting mold.

* * * * *